US012145769B2

(12) United States Patent
Chiado et al.

(10) Patent No.: US 12,145,769 B2
(45) Date of Patent: Nov. 19, 2024

(54) PLASTIC CONTAINER WITH LID

(71) Applicant: GEORG UTZ HOLDING AG, Bremgarten (CH)

(72) Inventors: Michael K. Chiado, Greenwood, IN (US); Axel Ritzberger, Altendorf (CH)

(73) Assignee: GEORG UTZ HOLDING AG, Bremgarten (CH)

( * ) Notice: Subject to any disclaimer, the term of this patent is extended or adjusted under 35 U.S.C. 154(b) by 62 days.

(21) Appl. No.: 18/040,433

(22) PCT Filed: Aug. 24, 2020

(86) PCT No.: PCT/IB2020/057892
§ 371 (c)(1),
(2) Date: Feb. 3, 2023

(87) PCT Pub. No.: WO2022/043728
PCT Pub. Date: Mar. 3, 2022

(65) Prior Publication Data
US 2023/0286697 A1 Sep. 14, 2023

(51) Int. Cl.
*B65D 21/06* (2006.01)
*B65D 43/16* (2006.01)

(52) U.S. Cl.
CPC ..... *B65D 21/064* (2013.01); *B65D 43/163* (2013.01); *B65D 2251/1083* (2013.01);
(Continued)

(58) Field of Classification Search
CPC ..... B65D 43/163; B65D 21/064; B65D 2251/1083; B65D 2543/00194; B65D 2543/00296
(Continued)

(56) References Cited

U.S. PATENT DOCUMENTS 4,974,746 A 12/1990 Dickinson
5,119,958 A 6/1992 Gabert et al.
(Continued)

FOREIGN PATENT DOCUMENTS

CA 2 863 692 A1 3/2016
DE 92 09 629 U1 11/1992
WO 2015/104521 A1 7/2015

OTHER PUBLICATIONS

International Search Report mailed on Jun. 1, 2021, in connection with corresponding PCT/IB2020/057892; 3 pages.

*Primary Examiner* — Robert J Hicks
*Assistant Examiner* — Sanjidul Islam
(74) *Attorney, Agent, or Firm* — McCormick, Paulding & Huber, PLLC

(57) ABSTRACT

A plastic container (1) with two lid halves (5*a*, 5*b*) rotatable about a hinge (6*a*, 6*b*) has on the inner surface (5*c*) of the lid halves hooks (7) arranged in a row adjacent to and along the hinges (6*a*, 6*b*). Each hook (7) extends parallel to and spaced apart from the lid half (5*a*, 5*b*) and includes a recess having an opening facing and toward the distal end (12*a*, 12*b*) and a two-sided undercut. The undercuts allow the placement of one or more bags (8) having two straps (9) inside the container (1) such that the bags (8) are held open. When the lid halves (5*a*, 5*b*) are closed the straps (9) remain in place and held by the hooks (7). The invention may be used by shoppers shopping large amounts, which may be placed in the bags. Several containers of this kind may be stacked when their lids closed.

8 Claims, 7 Drawing Sheets

(52) U.S. Cl.
CPC ..... *B65D 2543/00194* (2013.01); *B65D 2543/00296* (2013.01)

(58) Field of Classification Search
USPC ..... 220/810
See application file for complete search history.

(56) References Cited

U.S. PATENT DOCUMENTS 5,873,643 A * 2/1999 Burgess, Jr. ..... B65F 1/067 312/351
2006/0186123 A1* 8/2006 Baltz ..... E05D 7/1066 220/324

* cited by examiner

PLASTIC CONTAINER WITH LID

CROSS-REFERENCE TO RELATED APPLICATION

This application is a National Stage application of International Patent Application No. PCT/IB2020/057892, filed Aug. 24, 2020, the disclosure of which is incorporated herein by reference in its entirety.

TECHNICAL FIELD

The present invention pertains to a plastic container having a lid for the transport and storage of goods, where the lid comprises two parts each attached by a hinge to opposite upper rims of the container. Furthermore, it pertains to containers of this kind that are stackable when closed and stackable or nestable when opened.

BACKGROUND OF THE INVENTION

Such containers are commonly used and well known. For example, a container as disclosed in WO2015/104521 comprises a bottom, four side walls extending upwardly from the bottom, and two lid halves arranged by means of a hinge on the upper rim of opposite sidewalls. The lid halves may be pivotably rotated about the hinge from an open position, where they hang along the outside of the sidewalls, to a closed position. In the open position such containers may be stacked and nested within each other. In the closed position the free ends of the two lid halves each having corresponding contours interlace with each other forming a continuous, level surface over the open end of the container. As such, closed containers may be stacked.

A container with similar lids for closing is disclosed in CA 02863692.

SUMMARY

It is the object of the present invention to provide a stackable container of the afore-described type, which allows the placement of flexible receptacles such as sacks or bags to sub-divide the interior volume of the container.

According to the invention a plastic container is provided having a bottom and four sidewalls extending upwardly from the bottom to an open end of the container and a lid comprising two lid halves each attached to the upper rim of sidewalls opposite from each other by means of a hinge. The two lid halves are pivotably rotatable about the hinge from an open position to a closed position, where in the closed position the two lid halves form a level and continuous surface over the open end of the container.

The two lid halves having an inner surface, which face the interior of the container when they are in their closed position, each comprise one hook on said inner surface and arranged adjacent to the hinge of a lid half, or two or more hooks arranged in a row adjacent to and along the hinge of a lid half. Each hook comprises a hook body extending essentially parallel to and spaced apart from the inner surface of the lid half.

In a preferred embodiment of the invention, the hook body of each hook comprises a recess having an opening on a side of the hook body, which faces away from the hinge of the lid half and toward the distal end of said lid half. The recess features in particular a two-sided undercut.

In a particular embodiment of the invention, the angle of the undercuts relative to the lateral sides of the lid halves may range from 45° to 90°. In the case of an angle of 90° the recess comprises a shape of rectangle. In the case of an angle of approximately 45° the recess comprises a shape approximating a triangle.

The recess with undercuts of each hook body provide a hook function and allow the placement of a strap or handle of a bag or sack having two such straps or handles inside a container with open lid halves. The open lid halves can hang approximately alongside the outer side of the container's side walls either vertically or at some angle to the sidewalls. A first strap of the bag is anchored in a pair of hooks of a first lid half, and a second strap of the bag is anchored in a pair of hooks on the second lid half opposite the first lid half. The straps can thus be anchored on opposite sides of the container such that the sack or bag is held open and items may easily be placed inside.

Preferably, three or more hooks are arranged adjacent and along the hinge of each lid half. Thus, several sacks or bags may be arranged next to one another inside the container, where each bag is fully extended and its upper end held open. A first bag may be placed in the container using a first pair of hooks on each lid half. A second bag may be placed using a second pair of hooks. The second pair of hooks may consist of one of the hooks of the first pair of hooks and a further adjacent hook. Thus, bags may be placed immediately next to one another without any gap between each other. In this configuration, a given hook holds a strap of one bag in one of its undercuts and a strap of a second adjacent bag in the other of its two undercuts.

In a further embodiment of the invention, each hook body has no recess but a rectangular shape extending from the hinge towards the free or distal end of the lid half where said hook is arranged.

In a further embodiment of the invention, each hook body has a width, when measured parallel to the hinge of the lid half, which increases with distance from the hinge. For example, such hook has a shape approximating a triangle.

In a further embodiment of the invention, the hook body has the shape of a T, where the bottom, narrow end of the T is adjacent to the hinge and the top, wide end of the T is at the free end of the hook body.

When the hooks of the plastic container have hook bodies of rectangular shape, T-shape or a shape increasingly broad towards its free end, straps of bags or sacks may be placed by looping the straps about the hook bodies from either side.

A container according to the invention with bags arranged in any manner described above may be closed by pivotably rotating both lid halves about their hinges into their closed position. Due to the two-sided undercut of the recesses in the hook bodies, the straps held by pairs of hooks remain attached when the lid halves are pivoted closed as well as when they are again opened.

The container according to the invention may be used by shoppers intending a large shopping requiring multiple bags or similar receptacles. In order to easily and simultaneously fill several bags with different items, a container according to the invention may first be placed on a shopping push cart or preferably shopping push platform where bags or sacks are arranged in the above-described manner using the said pairs of hooks on the lid halves. Shopping items are placed in the several bags and the lid halves are then closed to form a level surface on the container top. A further container according to the invention may be placed on top of the first container and again provided with several bags using the hooks to latch the straps around such that the bags are open and may filled with further shopping items. By this manner, several containers, each with neatly arranged bags with shopping items may be filled, where the bags always remain neatly attached, independently of whether the container is closed or open. When done with the shopping, the customer opens the containers by rotating the lid halves into their open position where the straps are still in place and the bags neatly arranged. The customer can then remove the bags for further transport home.

In an embodiment of the invention all hooks in the row of hooks have a body with a recess with a two-sided undercut. Such row of hooks can have three or more hooks.

In a further embodiment of the invention the hooks at either end of a row of hooks and adjacent to a lateral side of a lid half have a body with a recess with just a one-sided undercut. These hooks require only a one-sided undercut as they need to only hold the strap of one bag or sack.

In a further embodiment of the invention, each lid half additionally comprises one or more openings arranged at the position in the lid half, where the one or more hook bodies are arranged, where said one or more openings are of the size and shape of the hook bodies and positioned immediately below the hook bodies.

The invention will be described in greater detail, by way of example, with reference to figures as follows.

DESCRIPTION OF THE PREFERRED EMBODIMENTS

FIGS. 1 to 4 show a container 1 according to the invention and the principle of the placement of a receptable within the container. The receptacle with two flexible straps or handles to carry the receptacle can be a bag, sack or net or any other suitable receptacle to hold various items.

Figure 1:
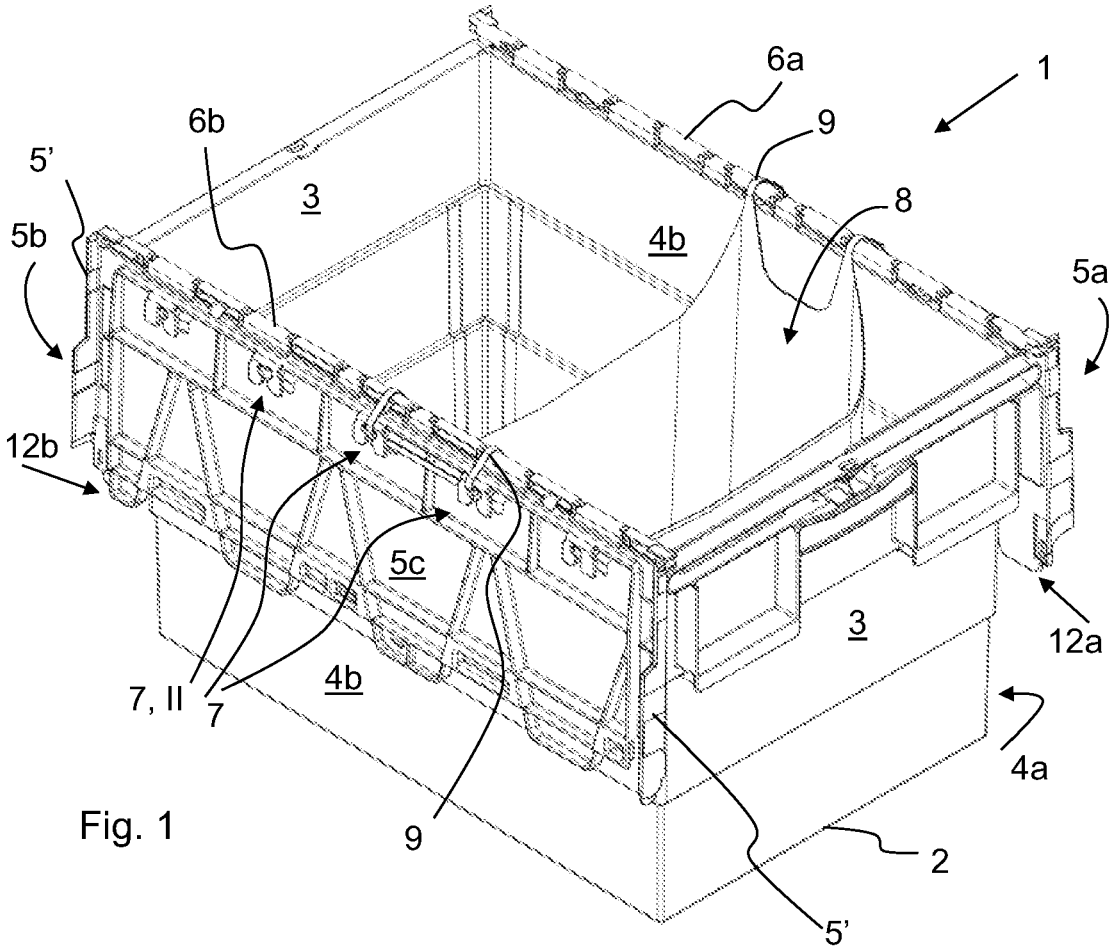
FIG. 1 shows a container according to the invention in a perspective view having one bag arranged within.
Figure 2:
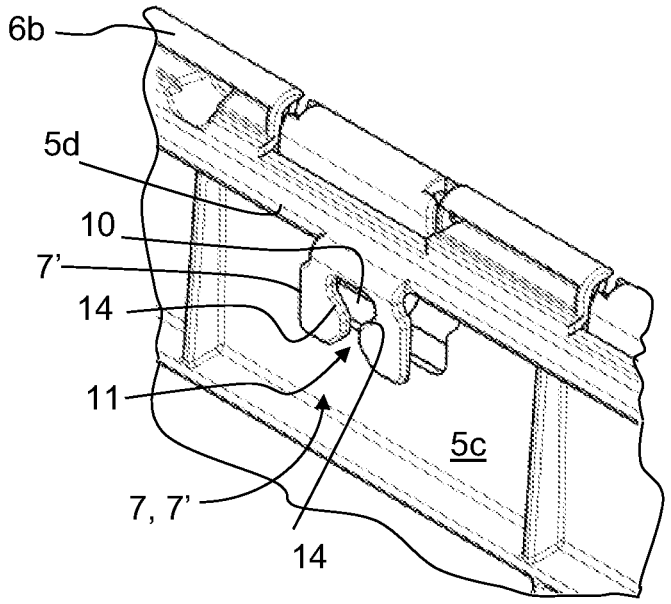
FIG. 2 shows a detail of one of the hooks in perspective.
Figure 3:
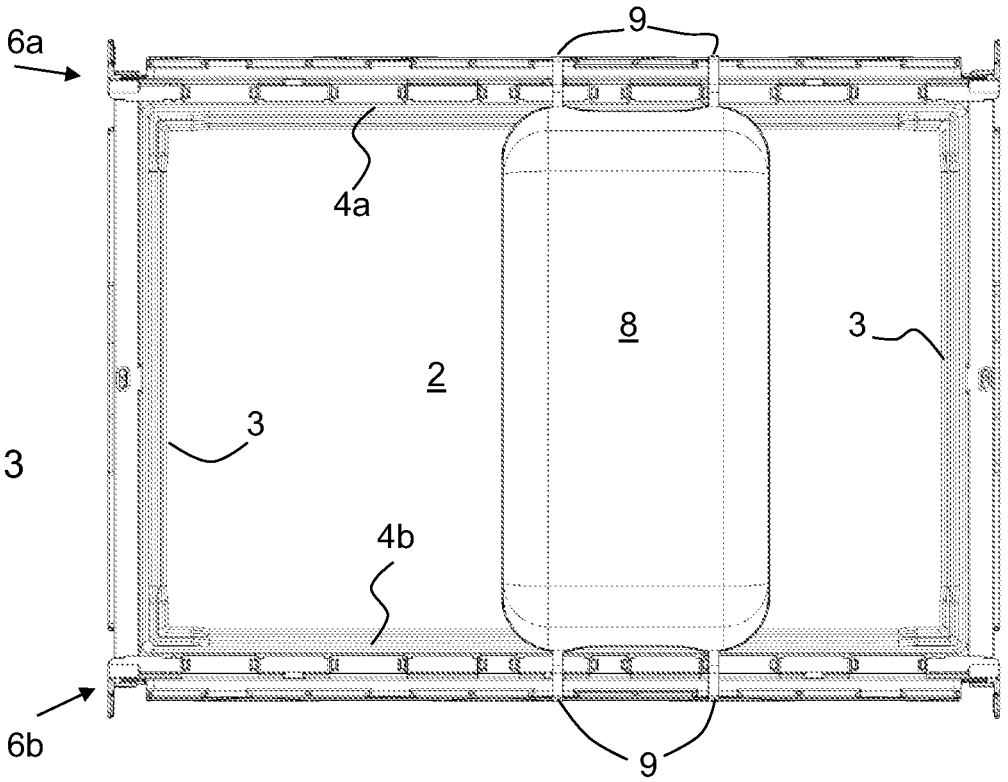
FIG. 3 shows the container of FIG. 1 in a top view.

The container 1 has a rectangular bottom 2, short sidewalls 3 and long sidewall 4*a* and 4*b* extending upwardly toward an open end of the container 1 and a lid for closing the container having a first lid half 5*a* attached to a first sidewall 4*a* and a second lid half 5*b* attached to the second sidewall 4*b* opposite the first sidewall 4*a*. The two lid halves 5*a* and 5*b* are each attached to the upper rim of the longer sidewalls 4*a* and 4*b* by a hinge 6*a* and 6*b* respectively. The FIGS. 1 to 3 show the lid halves 5*a* and 5*b* in their open position, where they hang down along the outer side of the sidewalls 4*a* and 4*b* respectively. In order to close the container 1, both lid halves 5*a* and 5*b* are pivotably rotated about their hinges 6*a* or 6*b* respectively about 270° until they reach a horizontal position.

Figure 4:
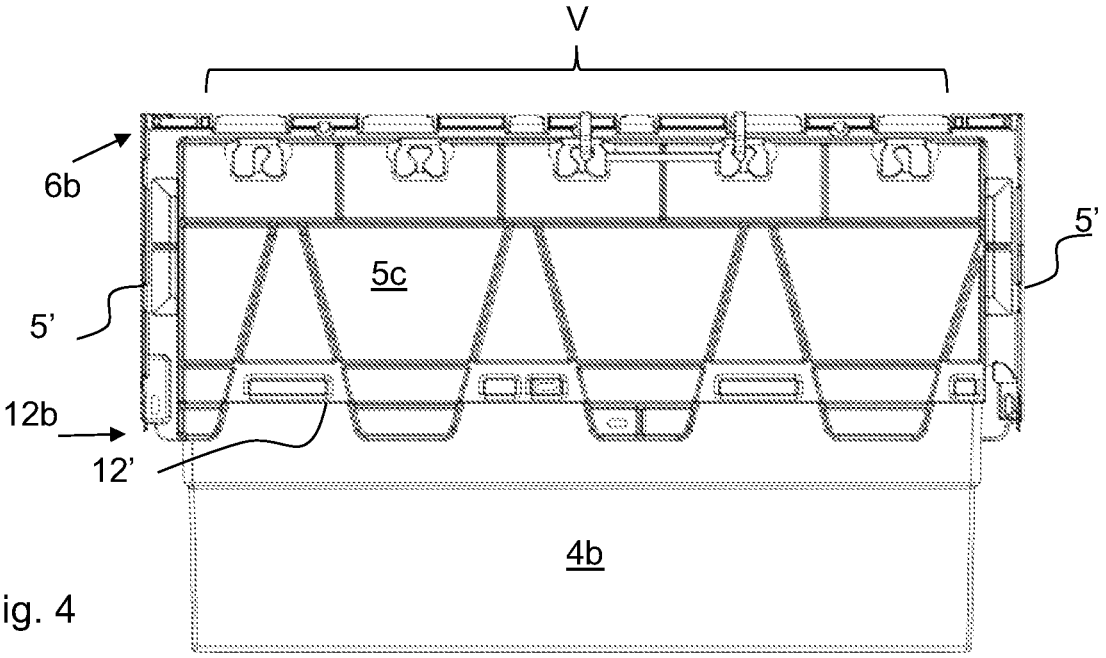
FIG. 4 shows the container of FIGS. 1 and 2 in a side view.

According to the invention, each lid half 5*a* and 5*b* comprises two or more hooks 7 arranged on the inner surface 5*c*, which faces outwardly when the lid half is open (as shown) and would face toward the interior of the container 1 when the lid half is in its closed position. In FIGS. 1 and 4 only one lid half is fully shown, whereas all features of the arrangement of the hooks pertain to both lid halves 5*a* and 5*b*. The row of hooks 7 are arranged adjacent to and along the length of the hinge 6*b* of lid half 5*b*. A bag 8 with two handles 9 is placed within the container 1 by means of its handles 9 held by the hooks 7 on lid half 5*a* and lid half 5*b*. Each hook 7, as shown in detail in FIG. 2, comprises a body 7' with a recess 10, where the opening 11 of the recess 10 points away from the hinge 6*b* and towards the distal or free end 12*b* of the lid half 5*b*. The body 7' of the hook 7 is arranged to extend parallel to the plane of the surface 5*c* of the lid half 5*b* such that there is a space between the hook body 7' and the inner surface 5*c* of the lid half 5*b*. The space between the hook body 7' and inner surface 5*c* of the lid half 5*b* allows a handle of a sack to be slid around the hook body 7 and through the opening 11 into the recess 10 of hook 7.

The lid half 5*b* further comprises an opening 13 approximately of the extent and shape of the hook body 7' and at the location of a hook body 7' such that the hook body 7' is visible through the lid half. This opening 13 is provided in connection with the production of container 1 and does not pertain to the function of the hook of holding bag handles.

As shown in FIG. 2, the hook 7 is attached to a rib 5*d* on the inner surface 5*c* of the lid half 5*b* allowing the hook 7 to be spaced apart from the inner surface 5*c* of the lid half 5*b*. The hook 7 may also be attached by another manner to the inner surface of the lid half.

Figure 5:
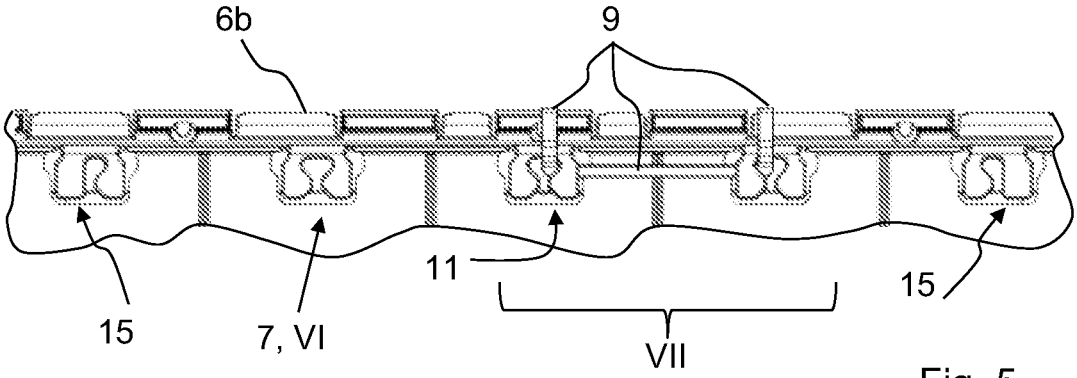
FIG. 5 shows in detail a row of hooks.
Figure 6:
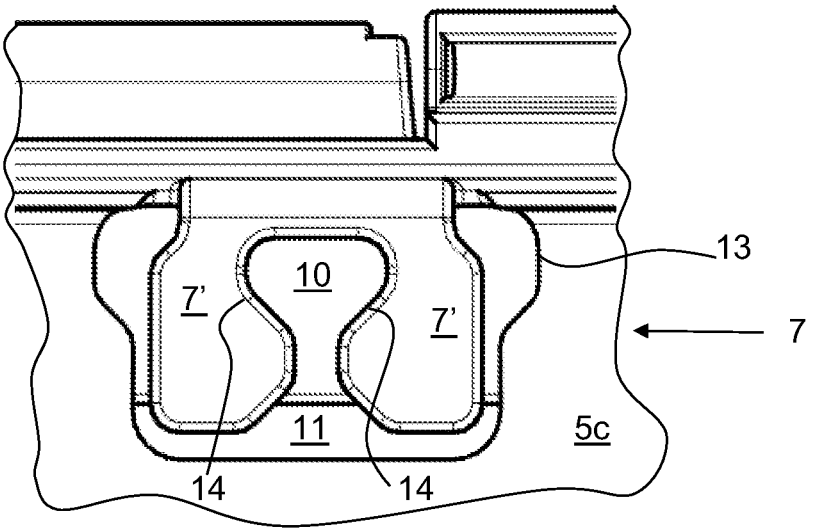
FIG. 6 shows a further detail of one single hook.
Figure 7:
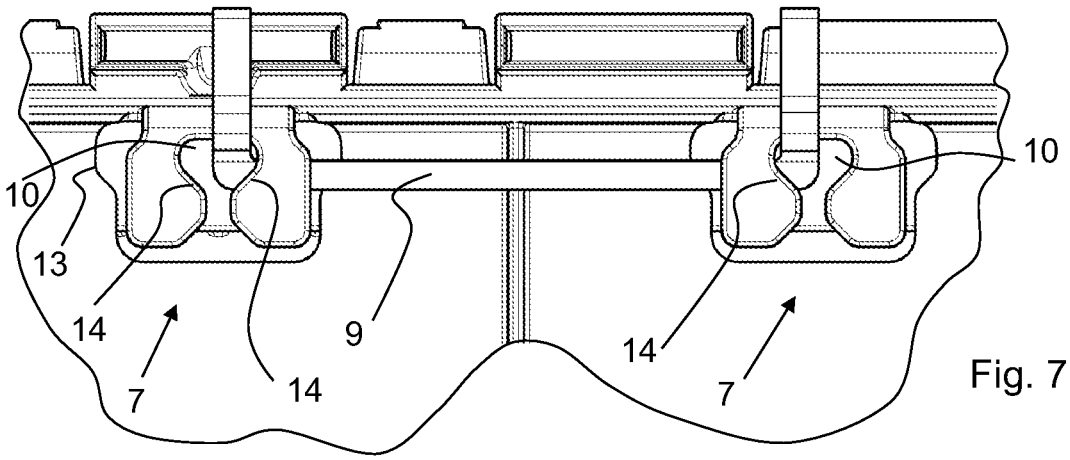
FIG. 7 shows a detail of a pair of hooks with a strap of a bag attached.

FIGS. 2 and 5-7 show the hooks 7 in more detail with and without a strap of a bag held by a hook. FIG. 5 shows an entire row of hooks 7 arranged along the hinge 6*b*, where one pair of adjacent hooks holds a strap 9 of a bag. The strap 9 is placed into the recesses 10 of two adjacent hooks 7, as shown in FIG. 7, each hook holding the strap by means of an undercut 14. Each hook comprises a hook body 7' with a recess 10, into which the straps 9 are placed. An opening 11 leading into the recess 10 is on the side of the body 7', which faces away from the hinge 6*b* and as such toward the free end 12*b* of the lid half 5*b*. The recess 10 has a two-sided undercut 14, which enables straps 9 to remain in the hook 7 when the lid half 5*b* is rotated into its closed position. The two-sided undercut 14 also allows the placement of two straps 9 into each hook 7, one strap belonging to a first sack, the second strap belonging to a second sack adjacent to the first, as described later in connection with FIG. 8.

Figure 8:
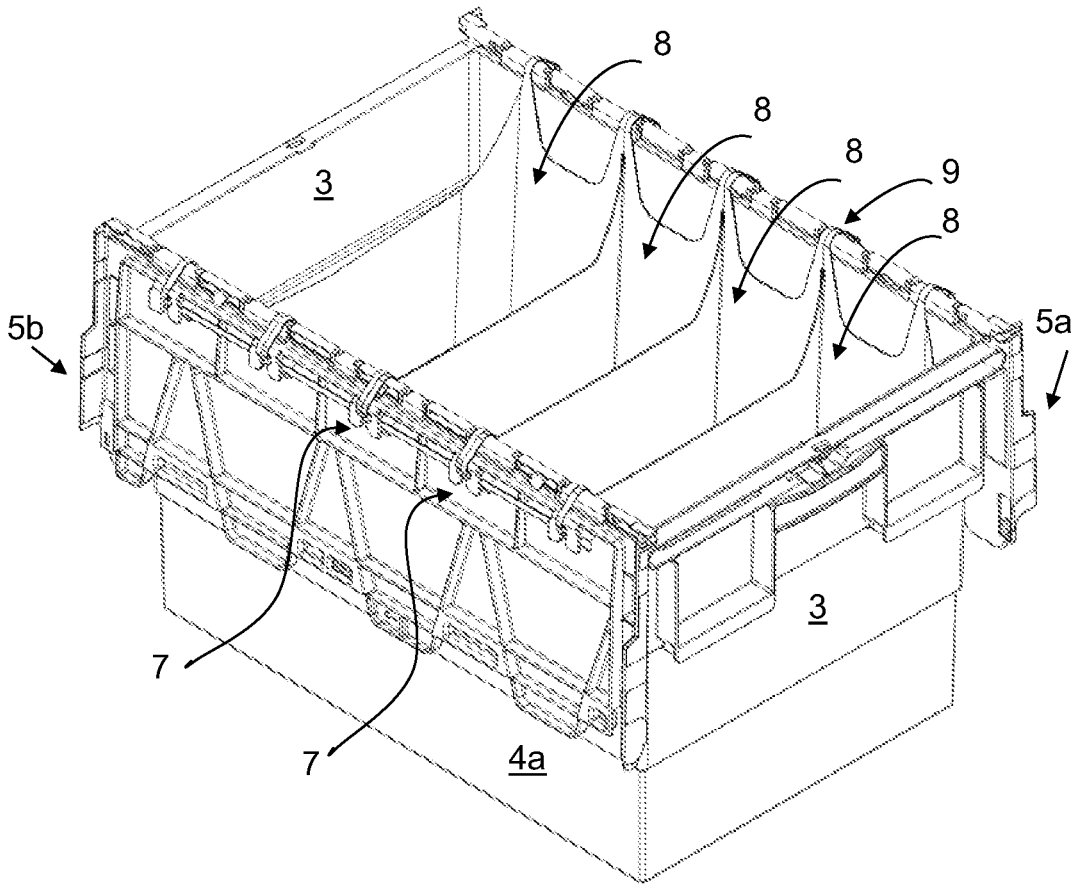
FIG. 8 shows the container of FIG. 1 with several bags arranged within.

The hooks 7 are provided with a two-sided undercut 14 in order to allow straps of two adjacent bags in the container to be held. Preferably all hooks 7 in the row are provided with two-sided undercuts 14. However, as shown in FIG. 5 and FIG. 8, it is sufficient that the three hooks in the centre portion of the lid half 5*b* have a two-sided undercut 14, where the hooks placed immediately next to the lateral edges of a lid half 5*b* may comprise only a one-sided undercut as the outermost hooks next to the lateral edges must only hold one bag strap. FIG. 5 shows the hooks at the very right and the very left end of the row, which have a one-sided undercut 14. The hooks having a one-sided undercut 14 feature the undercut on the side of the body 7' facing the middle of the lid half 5*b*, as this is sufficient to hold a strap together with the hook adjacent to it. The recesses of the hooks with one-sided undercut are shaped with a straight-edge 15 opposite the undercut as shown in FIG. 5.

FIG. 8 shows a same container 1 fully filled by several bags 8, their straps 9 looped about adjacent hooks 7, where the three centre hooks 7 each hold straps of two adjacent bags 8 and the hooks 7 at either lateral side of the lid half hold just one strap.

Figure 9:
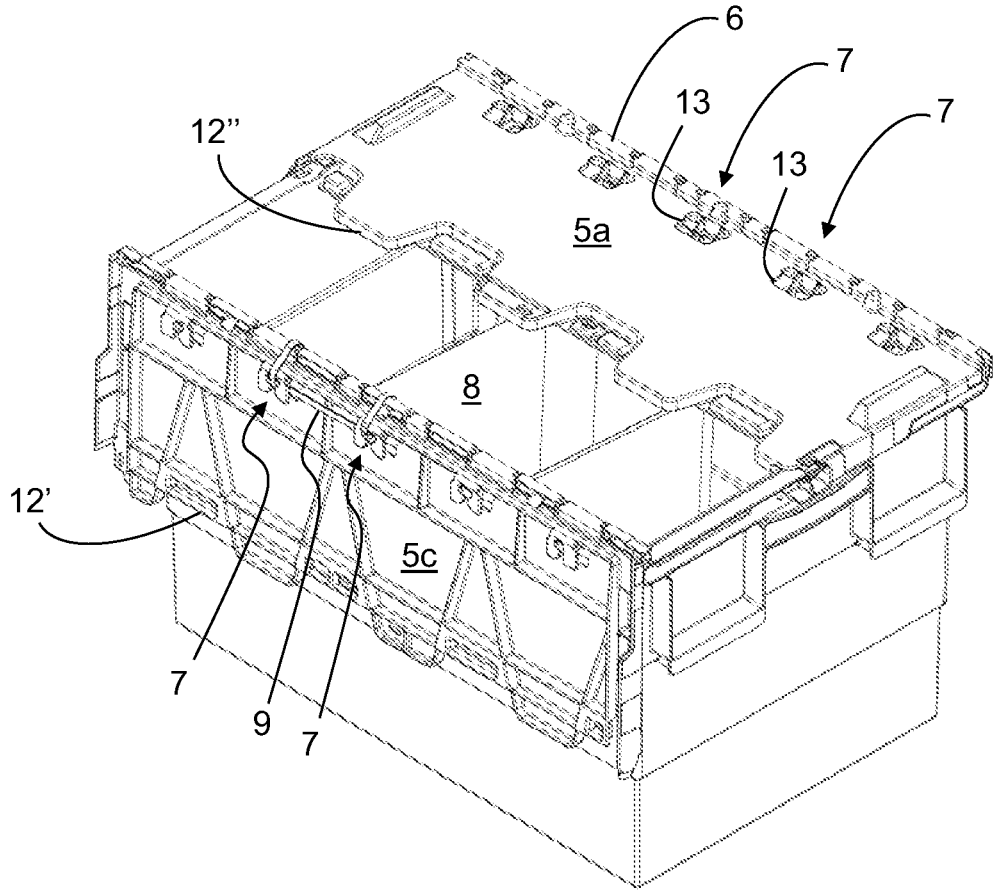
FIG. 9 shows the container of FIG. 1 with one bag arranged within and one lid half in closed position.
Figure 10:
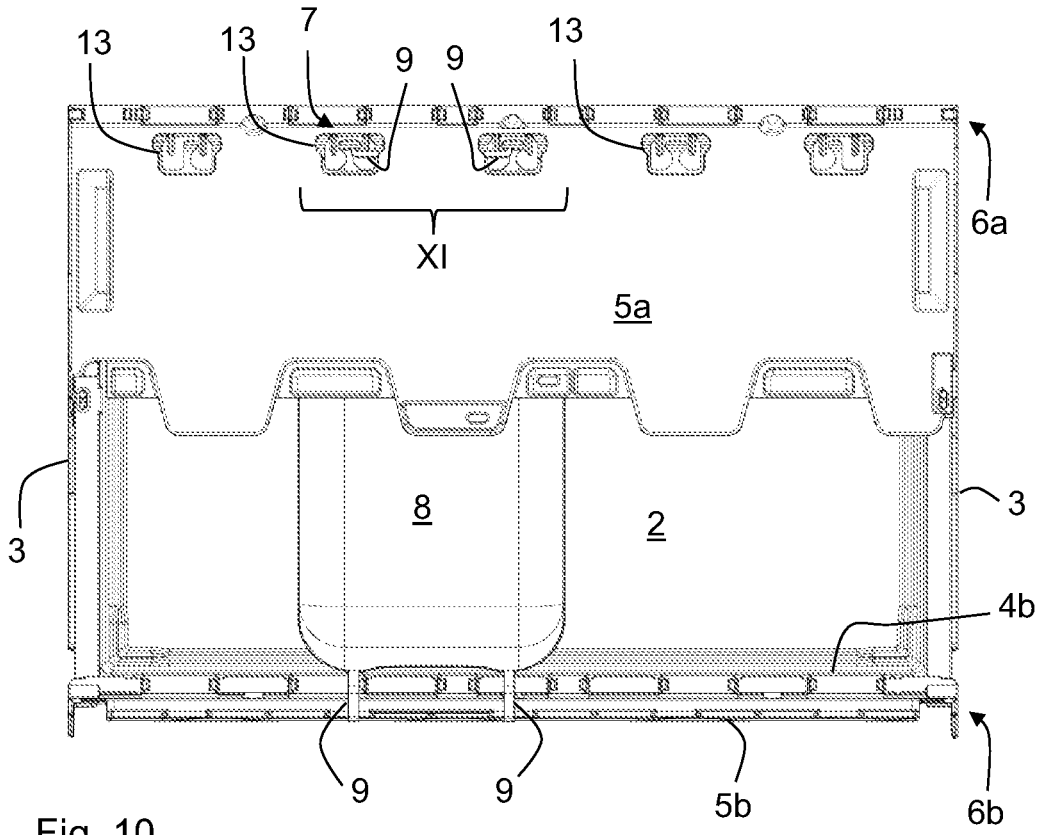
FIG. 10 shows the container of FIG. 5 on a top view.
Figure 11:
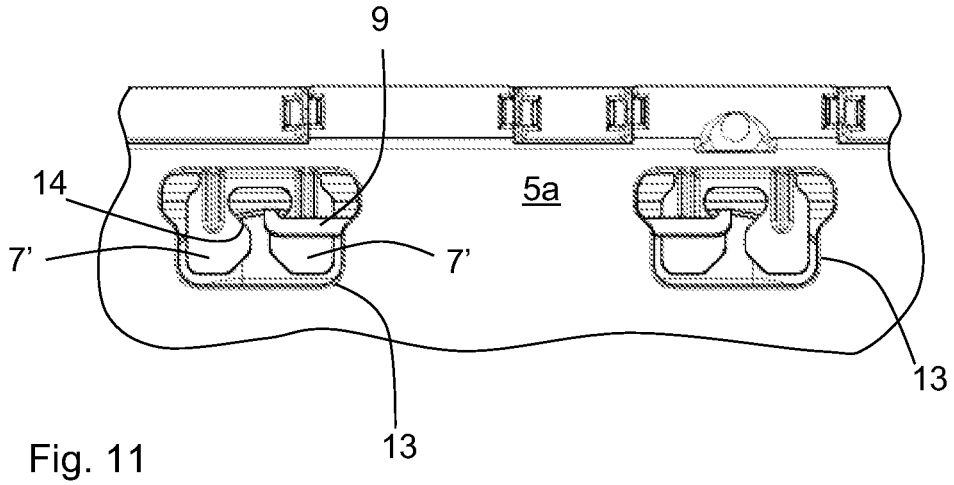
FIG. 11 shows a detail of the hooks in FIG. 8.

FIGS. 9 to 11 show a container 1 of same kind with one bag 8 placed inside using the hooks 7 to hold its straps 9 and one lid half 5*a* pivotably rotated about hinge 6*a* into its closed position. Although the lid half is in its horizontal closed position, the bag 8 remains with its straps 9 held by the hooks and the bag opening extended fully. The top views of the container in FIGS. 10 and 11 show the openings 13 in the lid half 5*a* through which the hooks 7 are visible.

Figure 12:
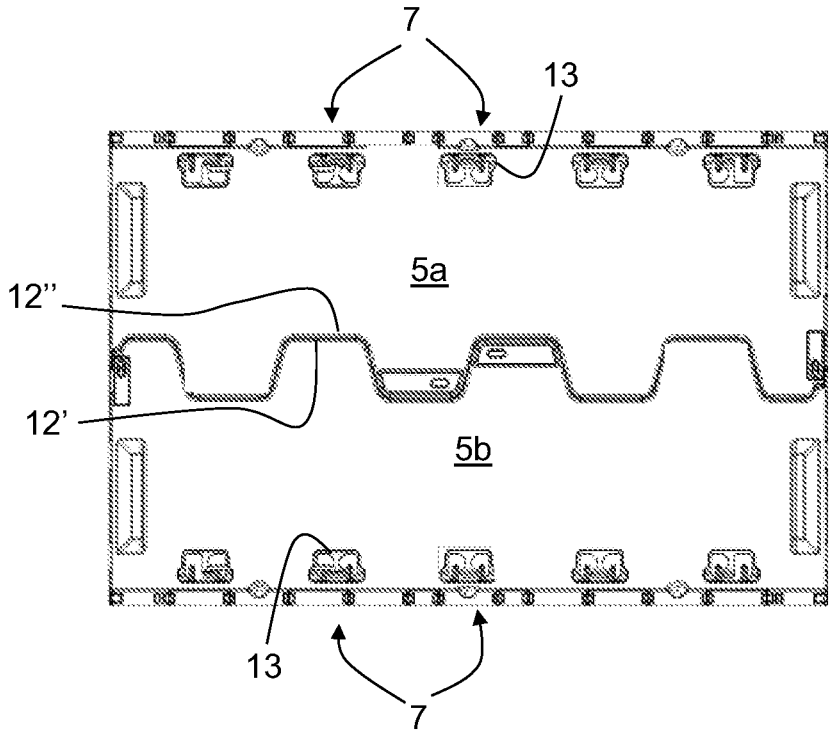
FIG. 12 shows a top view of the container of FIG. 1 with both lid halves in closed position.

FIG. 12 shows the same container with both lid halves 5*a* and 5*b* in their closed position in a view onto the outer surfaces of the lid halves 5*a* and 5*b*. Each lid half 5*a* and 5*b* has a contour at its distal or free end. The first lid half 5*a* extends to its distal end having contour 12", and the second lid half 5*b* extends to its distal end with contour 12'. The two contours 12' and 12" are shaped corresponding to one another such that in the closed position of the two lid halves 5*a* and 5*b* they interlace with each other forming a continuous planar horizontal surface. A second container of same kind may be stacked on top of the closed lid of the shown container. All openings 13 in the two lid halves 5*a* and 5*b* allow a view onto the row of several hooks 7 each arranged below the openings 13, where straps of a bag are held by the two left-most hooks in the row.

In all embodiments shown in FIGS. 1-11, the recesses 10 in the hook bodies 7' (after their opening 11) have an approximately triangular shape, where the angle of the undercuts relative to the lateral sides 5' (as indicated in FIGS. 1 and 4) of the lid halves is approximately 45°. The angle of the undercuts may also be larger up to 90°. If the angle were 90° the recesses 10 would have an approximate shape of a rectangle.

Although various embodiments of the present invention have been described and shown, the invention is not restricted thereto, but may also be embodied in other ways within the scope of the subject-matter defined in the following claims.

What is claimed is:

1. A plastic container having a bottom and four sidewalls extending upwardly from the bottom to an open end of the container and a lid comprising two lid halves each attached by means of a hinge to the upper rim of two sidewalls opposite from each other, where the two lid halves are each pivotably rotatable about the hinge from an open position to a closed position, where in the closed position the two lid halves form a level and continuous surface over the open end of the container and the two lid halves each have an inner surface, which face the interior of the container when they are in their closed position, wherein each lid half comprises at its inner surface one hook arranged adjacent to the hinge of said lid half or two or more hooks arranged to form a row of hooks adjacent to and along the hinge of said lid half, where each hook comprises a body extending parallel to and spaced apart from the inner surface of said lid half, and each hook body comprises a recess having an opening arranged on a side of the hook body, which faces away from the hinge and toward the distal end of said lid half, and the recess comprises a two-sided undercut.

2. The container according to claim 1, wherein the row of hooks comprises three or more hooks.

3. The container according to claim 1, wherein each lid half comprises at the inner surface of the lid half a further hook arranged at either end of the row of hooks and adjacent to a lateral side of a lid half, where each said further hook comprises a body extending parallel to and spaced apart from the inner surface of said lid half and the hook body comprises a recess having an opening on a side of hook body, which faces away from the hinge of the lid half and toward the distal end of said lid half and where the recess comprises a one-sided undercut.

4. The container according to claim 1, wherein each hook body has a rectangular shape extending from the hinge towards the free or distal end of the lid half where said hook is arranged.

5. The container according to claim 1, wherein each hook body extends from the hinge towards the distal or free end of the lid half where the hook is arranged and each hook body has a width, when measured parallel to the hinge of the lid half, that increases with distance from the hinge.

6. The container according to claim 5, wherein each hook body has a triangular shape.

7. The container according to claim 1, wherein each hook body has the shape of a T, where the bottom, narrow end of the Tis adjacent to the hinge and the top, wide end of the Tis at the free end of the hook body.

8. A plastic container having a bottom and four sidewalls extending upwardly from the bottom to an open end of the container and a lid comprising two lid halves each attached by means of a hinge to the upper rim of two sidewalls opposite from each other, where the two lid halves are each pivotably rotatable about the hinge from an open position to a closed position, where in the closed position the two lid halves form a level and continuous surface over the open end of the container and the two lid halves each have an inner surface, which face the interior of the container when they are in their closed position, wherein each lid half comprises at its inner surface one hook arranged adjacent to the hinge of said lid half or two or more hooks arranged to form a row of hooks adjacent to and along the hinge of said lid half, where each hook comprises a body extending parallel to and spaced apart from the inner surface of said lid half, and each lid half additionally comprises one or more openings arranged at the position in the lid half, where the one or more hook bodies are arranged, wherein said one or more openings have a size and shape approximately that of the hook bodies and the one or more openings are positioned immediately adjacent the hook bodies.

* * * * *